US009652932B2

(12) United States Patent
Nonaka

(10) Patent No.: US 9,652,932 B2
(45) Date of Patent: May 16, 2017

(54) ACCOUNT ADJUSTING SYSTEM

(75) Inventor: Nobuyuki Nonaka, Tokyo (JP)

(73) Assignee: UNIVERSAL ENTERTAINMENT CORPORATION, Tokyo (JP)

( * ) Notice: Subject to any disclaimer, the term of this patent is extended or adjusted under 35 U.S.C. 154(b) by 1920 days.

(21) Appl. No.: 11/772,463

(22) Filed: Jul. 2, 2007

(65) Prior Publication Data

US 2008/0009342 A1 Jan. 10, 2008

(30) Foreign Application Priority Data

Jul. 5, 2006 (JP) ..... 2006-185708

(51) Int. Cl.
*G07F 17/32* (2006.01)

(52) U.S. Cl.
CPC ..... *G07F 17/3244* (2013.01); *G07F 17/32* (2013.01); *G07F 17/3255* (2013.01)

(58) Field of Classification Search
CPC .. G07F 17/32; G07F 17/3244; G07F 17/3251; G07F 17/3246; G07F 17/3255
USPC ..... 463/25
See application file for complete search history.

(56) References Cited

U.S. PATENT DOCUMENTS 4,339,798 A * 7/1982 Hedges et al. ..... 463/26
5,505,461 A * 4/1996 Bell et al. ..... 463/25
6,312,333 B1 * 11/2001 Acres ..... 463/25
2004/0176975 A1 * 9/2004 Fujimoto ..... 705/1
2004/0210487 A1 * 10/2004 Fujimoto et al. ..... 705/17
2005/0020354 A1 * 1/2005 Nguyen et al. ..... 463/25
2005/0153774 A1 7/2005 Okada
2005/0170884 A1 * 8/2005 Okada ..... G07F 17/3269 463/25

FOREIGN PATENT DOCUMENTS

JP 2005-168755 6/2005
JP 2005-192991 7/2005

* cited by examiner

*Primary Examiner* — Jasson Yoo
(74) *Attorney, Agent, or Firm* — KMF Patent Services, PLLC; Kenneth Fagin; S. Peter Konzel

(57) ABSTRACT

An account adjusting system according to an embodiment of the invention comprises a game machine that pays an award corresponding to a kind of a prize of a game; and an account adjusting apparatus that adjusts an account for a user. The game machine has a paying section for determining an award corresponding to a kind of a prize of a game and a determining section for determining whether or not tax payment is required based on the award determined by the paying section, and when determining that tax payment is required, transmitting award information indicative of the award to the account adjusting apparatus. The account adjusting apparatus has a receiving section for receiving the award information; a tax payment amount calculating section for calculating a tax payment amount based on the award information; and a tax payment certificate providing section for producing an output to prepare a tax payment certificate based on the tax payment amount.

10 Claims, 11 Drawing Sheets

FIG. 8

800

| | ITEM | PRICE |
|---|---|---|
| 801 | | |
| 802 | ACCOMMODATION | $500.00 |
| 803 | RESTAURANT | $300.00 |
| 804 | PURCHASE IN SHOP | $700.00 |
| 805 | AWARD IN CASINO | -$1.200.00 |
| 806 | TAX | $360.00 |
| | ACCOUNT | $660.00 |

ACCOUNT ADJUSTING SYSTEM

The present disclosure relates to subject matter contained in Japan Patent Application No. 2006-185708 filed on Jul. 5, 2006, which is expressly incorporated herein by reference in its entireties.

BACKGROUND OF THE INVENTION

The present invention relates to an account adjusting system, and more particularly, to an account adjusting system enabling tax payment procedures required for an award to be performed at the time of adjusting an account such as the time of checking out a hotel and the like, when the award paid from a game machine such as a slot machine and the like has an amount requiring tax payment.

A variety of game machines is installed in a game hall such as a casino and the like, and is able to provide games to game players.

As game machines that pay out media (hereinafter, referred to as "coins") such as medals, coins and the like used in a game corresponding to a kind of a prize of the game, various kinds of game machines are known such as a card game machine which displays card images showing playing cards while varying display of each of the card images according to operational input of a player and thus develops the game, a slot machine and the like. Among these game machines, the slot machine generally has a plurality of reels (mechanical reels) with symbols added to their outer circumference surfaces, or a plurality of reels displayed by image (hereinafter, the reel displayed by image is referred to as a "video reel".)

In any slot machines, when a player performs predetermined operation, each reel rotates or scrolls, and by a combination of respective symbols (hereinafter, a combination of symbols is referred to as a "symbol pattern") of reels on a predetermined effective line (pay line) at the time each reel stops, whether or not the player wins a prize in the game is determined. An aspect (prize aspect) in wining the prize is further determined by such a combination, and a predetermined award is paid to the player according to the prize aspect.

In the slot machine, the number of coins to pay varies with prize aspects, and among the prize aspects, there is provided a prize aspect that is a big prize (the so-called big hit, jackpot and the like) to pay out an amount extremely larger than normal amounts. When a player gets a prize aspect that is the big prize, since the slot machine pays out a large amount of game values as an award, the player performs the game while hoping to get the big prize.

However, in the country and region where game machines are installed, there is a case that it is mandatory to pay a predetermined tax when a large amount of ward is paid out. For example, in casinos in U.S., when wining a big prize such that the amount of award paid out of the slot machine is 1,200 dollars or more, the player needs to pay a tax with respect to a scheduled payout to receive. In this case, the game machine is controlled to shift to the so-called lock state that halts the operation without paying out a big prize won by the player, and the player needs to wait (for example, about five to ten minutes) for a service person of the game hall who performs procedures such as document preparation and the like required to pay the tax to arrive. Further, the player needs to wait for the game to resume until finish of a series of tax payment procedures such that the tax is collected, and a certificate of tax payment is written and received.

To solve the problem of the tax payment procedures, game machines are proposed (for example, Patent Document 1 (Japanese Unexamined Patent Publication No. 2005-168755) and Patent Document 2 (Japanese Unexamined Patent Publication No. 2005-192991) to automatically deduct a tax amount and pay out an amount of award with the tax subtracted therefrom.

However, also in the game machine which automatically deducts a tax amount and pays out an amount of award with the tax subtracted therefrom as described above, when getting a prize aspect requiring tax payment procedures, the effort of tax payment is eliminated, but the work to write a tax payment certificate is certainly required after the game is finished, and it takes a time for the work. Therefore, the player loses not only the playing time in the casino, but also the time of using other facilities (shop, restaurant, theater and the like) provided in the hotel.

Accordingly, required are a game machine enabling a player to pay a tax in wining a prize requiring tax payment without waiting, and a game system having the game machine and a game server.

BRIEF SUMMARY OF THE INVENTION

In an aspect of the present invention, there is provided an account adjusting system having a game machine (for example, slot machine) that pays an award corresponding to a kind of a prize of a game, and an account adjusting apparatus (for example, account adjusting server) that adjusts an account for a user.

The game machine used in the account adjusting system according to an another aspect of the present invention is characterized by having a drawing section (for example, a main CPU) for determining success or failure of acquisition of a prize by a drawing, a paying section (for example, the main CPU) for determining an award when the drawing section determines acquisition of the prize, and a determining section (for example, the main CPU functioning as a tax payment need/no-need determining section) for determining whether or not tax payment is required based on the award determined by the paying section, and when determining that tax payment is required, transmitting award information (for example, information indicative of an award amount included in a tax payment processing request message) to the account adjusting apparatus, where the account adjusting apparatus has a receiving section (for example, a CPU functioning as a tax payment processing request message receiving section) for receiving the award information, a compiling section (for example, the CPU) for receiving purchase information of the user, and generating account adjusting information based on the purchase information, the award information, and a tax payment amount determined based on the award information, statement of account issuing section (for example, the CPU) for making issue of a statement of account based on the account adjusting information, and a tax payment certificate providing section (for example, the CPU) for producing an output to prepare a tax payment certificate based on the award information and tax payment amount.

The above-mentioned account adjusting system may have following characteristics. In other words, the above-mentioned account adjusting system further has a game server connected between the game machine and the account adjusting apparatus. The game server has a tax payment amount calculating section (for example, a CPU) for receiving the award information from each game machine, and calculating a tax payment amount based on the received award information, and a transmitting section (for example, the CPU functioning as a tax payment amount transmitting section) for transmitting tax payment amount information indicative of the tax payment amount together with the award information to the account adjusting apparatus.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 8 is a diagram showing a data configuration example of account adjusting information generated by compiling purchase information;

DETAILED DESCRIPTION OF THE INVENTION

An embodiment of the invention will specifically be described below with reference to accompanying drawings.

[System Configuration Example of an Account Adjusting System]

An embodiment of the invention is proposed as an account adjusting system. This account adjusting system is such a system that in a casino attached to a hotel, as the result of a person who stays in the hotel playing a game in the casino, when the person acquires an award (also referred to as payout) requiring tax payment procedures, the person is capable of completing tax payment procedures including preparation of a tax payment certificate concurrently with adjustment of expenses such as the cost of accommodation and the like in checking out the hotel.

In the account adjusting system in this embodiment, a guest or visitor is capable of implementing payout/adjustment procedures in a hotel using a house card.

The hotel provides a user with the house card storing information (ID information and the like) capable of specifying the user. A house-card user presents the house card in getting various kinds of hotel services in the hotel. Card readers (that may have the writing function) are installed in rooms, restaurants, stores, casino and the like in the hotel, the status of use of the card is transmitted to an account adjusting server, and the use amount and the like are accumulated for each user. Therefore, the user is capable of getting various kinds of hotel services in a cashless manner and collectively adjusting an account in check-out.

Further, at the time of obtaining the house card or any time after obtaining the house card, the guest can deposit the amount to receive various kinds of casino services in a casino in each place in the hotel. The amount is beforehand designated for each user, beforehand paid to the hotel by reserving to adjust an account in check-out, paying cash, or using a debit card, credit card or the like, and written in the card together with the ID information. Then, in getting the casino service in the hotel, the user shows the house card. In facilities and places where slot machines, card tables, roulettes and the like are played, writable card readers are installed, and the deposit amount is rewritten whenever getting the service. Thus, the user is capable of getting various kinds of casino services in a cashless manner, and collectively adjusting the deposit amount together with amounts of hotel services in check-out. Further, it is naturally possible for the server to record and manage the amount, instead of directly recording the amount in the house card.

Figure 1:
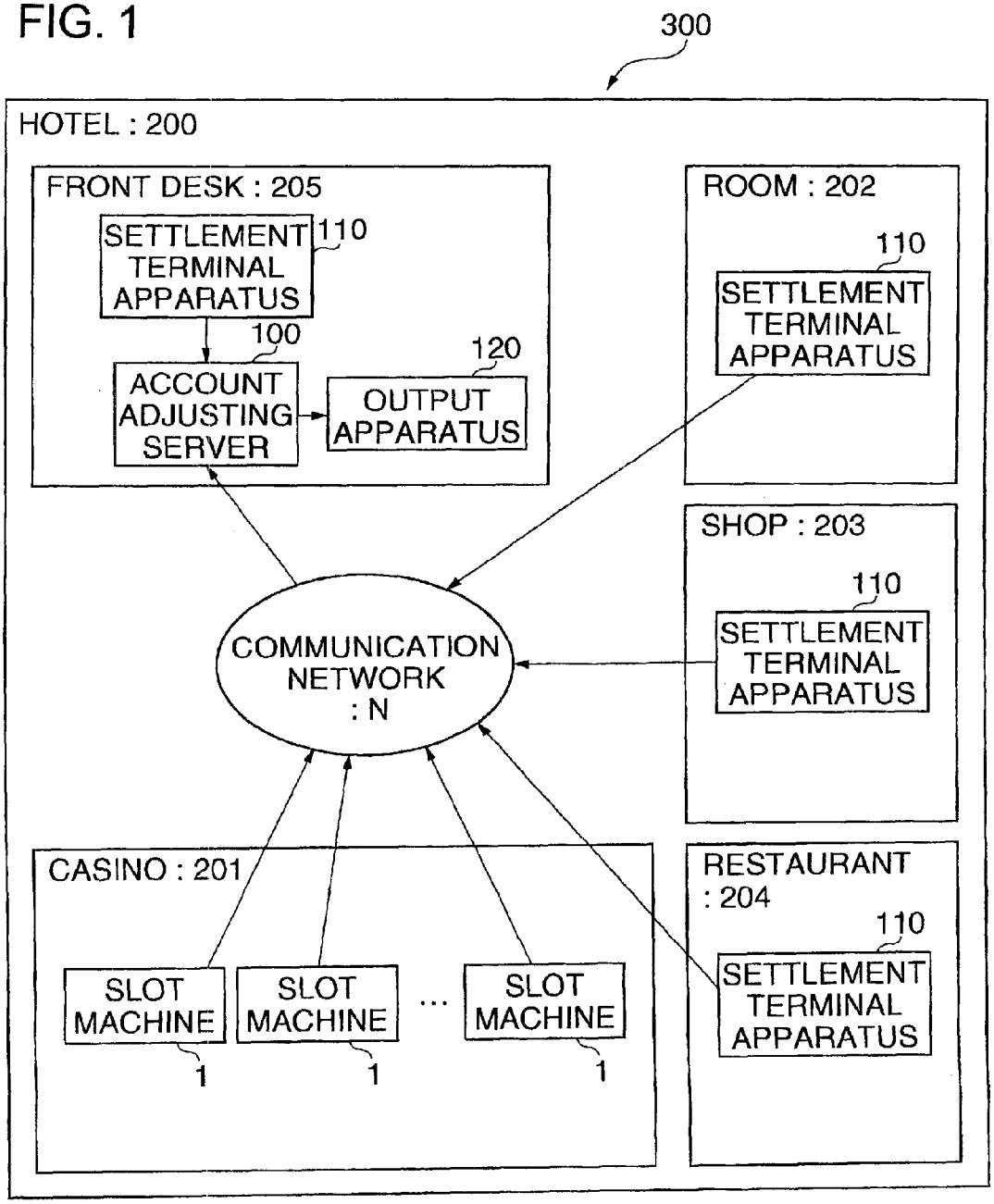
FIG. 1 is a system configuration diagram illustrating an entire account adjusting system.

FIG. 1 is a system configuration diagram illustrating an entire example of an account adjusting system 300 according to the embodiment of the invention. The account adjusting system 300 is a system used by a hotel 200.

The hotel 200 has a casino 201 that is a game hall, while having various facilities and stores such as rooms 202 as accommodations, shop 203, restaurant 204 and the like that users such as guests, visitors and the like can use.

Further, a front desk 205 is provided to perform check-in operations, check-out operations and adjustment operations in check-out for guests and users.

The hotel 200 is provided with a communication network N to connect apparatuses installed in the hotel to communicate with one another.

An account adjusting server 100 is installed in the hotel 200. FIG. 1 shows the account adjusting server 100 disposed at the front desk 205, but the server 100 does not need to be always installed at the front desk 205. Further, the account adjusting server 100 capable of connecting to the communication network N may be installed outside the hotel 200.

In the account adjusting system 300, slot machines 1 that are game machines, the account adjusting server 100, settlement terminal apparatuses 110 are connected via the communication network N (LAN: Local Area Network, Internet or the like), and the slot machines 1 are capable of communicating with the account adjusting server 100, while the settlement terminal apparatuses 110 are capable of communicating with the account adjusting server 100. In the account adjusting system 300, each of the slot machines 1 transmits a tax payment processing request message described later to the account adjusting server 100 via the communication network N.

[Slot Machine]

Described below is the slot machine 1 that is one of structural elements of the account adjusting system.

(An Entire Configuration of the Slot Machine)

Figure 2:
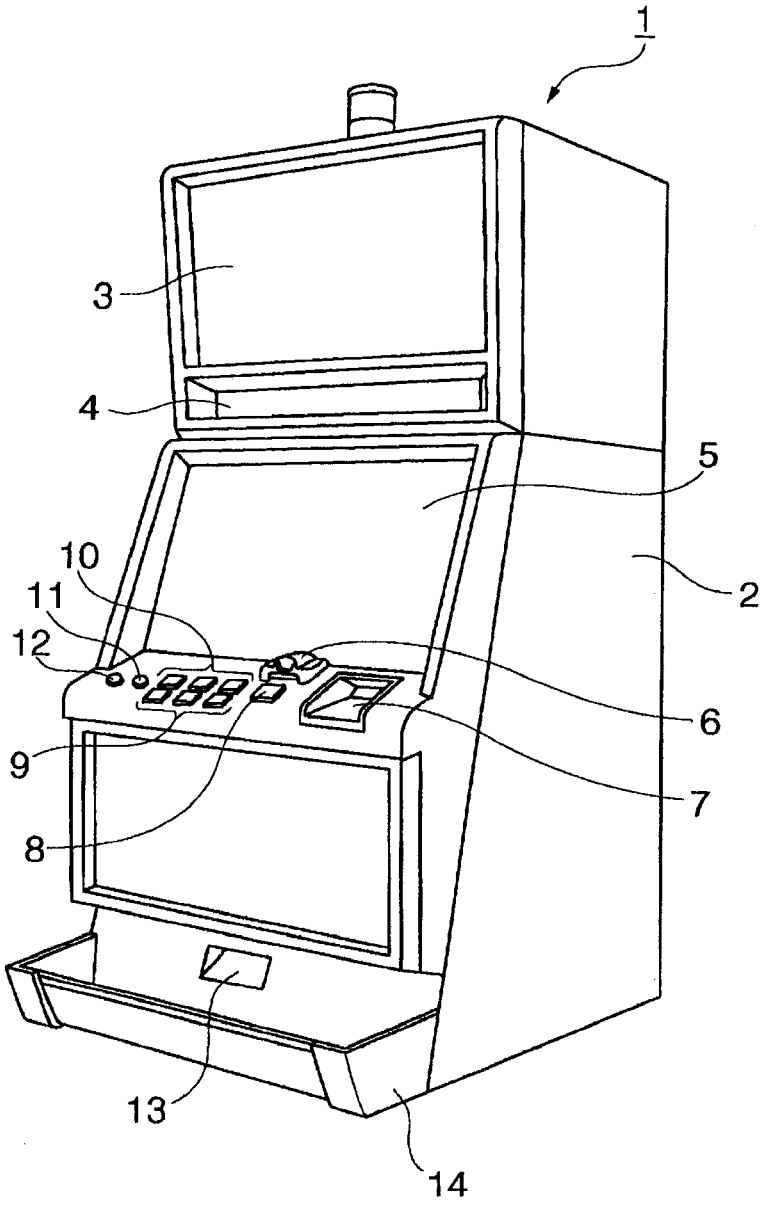
FIG. 2 is a perspective view showing an entire configuration of a slot machine.

FIG. 2 is a perspective view showing the entire configuration of the slot machine. The slot machine 1 is a game machine according to the embodiment of the invention, has a variable display section for variably displaying a plurality of symbols, and is configured to display a plurality of pseudo reels in the variable display section to play a game. A player makes a judgment whether or not a prize is won by a combination of symbols on an effective line at the time each of the pseudo reels stops.

In the slot machine 1, liquid crystal display panels 3, 4 and 5 are installed at the front of a housing 2 from above. The liquid crystal display panel 3 displays images (for example, three-dimensional moving pictures for game representation to boost the game and the like) that are not directly related to the game. The liquid crystal display panel 4 displays explanations such as a game execution method and the like.

The liquid crystal display panel 5 displays a plurality of pseudo reels, and symbols on each of the pseudo reels are variably displayed (scrolled and displayed).

Further, the housing 2 is provided with a coin insertion opening 6 to insert a coin to bet on the game, and a bill insertion opening 7 to insert a bank bill each under the liquid crystal display panel 5. Further, a spin button 8, BET selection button 9, line selection button 10, stop button 11 and payout button 12 are provided in this order from the bill insertion opening 7 to the left as viewed.

The spin button 8 inputs a start signal for a player to instruct to start a game by operational input of the player, and to start variable display of the pseudo reels in the liquid crystal display panel 5. The BET selection button 9 inputs a BET selection signal for the player to select the number of (for example, one, two or ten) coins to be bet to set. The line selection button 10 inputs a line selection signal for the player to select a desired effective line from among a plurality of effective lines not shown in the figure by operational input of the player. The stop button 11 inputs a stop signal to instruct to stop the pseudo reels that are variably displayed. The payout button 12 performs the operation for switching between credit and payout of coins acquired by the player, and inputs a payout signal to pay out coins when the coins are credited. Then, the housing 2 is provided on the bottom with a coin payout opening 13 and a coin receiving portion 14 that holds the paid out coins.

Figure 3:
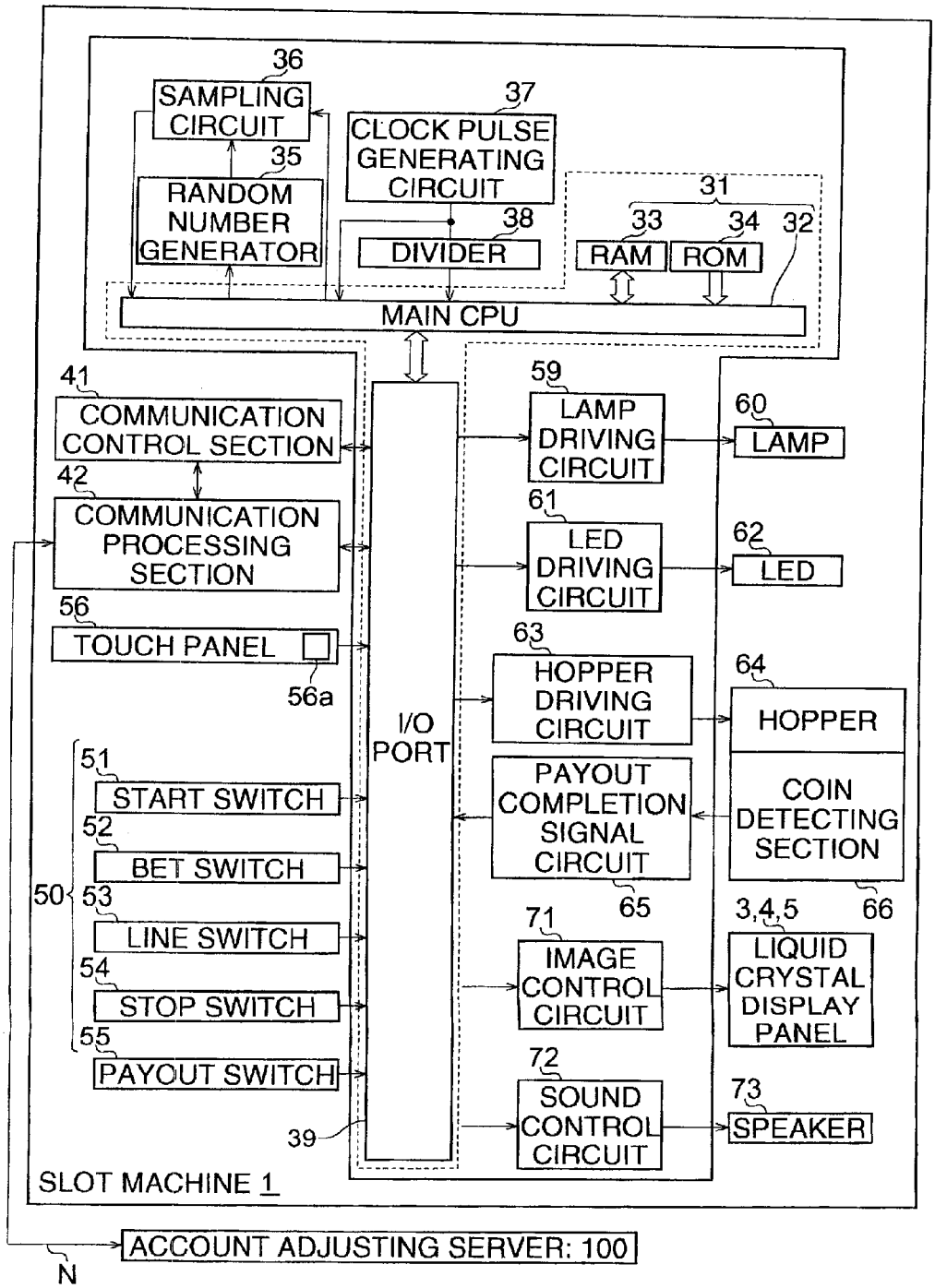
FIG. 3 is a block diagram mainly illustrating an internal configuration of the slot machine.

FIG. 3 is a block diagram of the slot machine 1 mainly showing an internal configuration. The slot machine 1 has a plurality of structural elements with a microcomputer 31 as a center.

The microcomputer 31 has a main CPU (Central Processing Unit) 32, RAM (Random Access Memory) 33, and ROM (Read Only Memory) 34. The main CPU 32 operates according to a program stored in the ROM 34, receives and outputs signals from/to the other structural elements via an I/O port 39, and controls the operation of the entire slot machine 1. The RAM 33 stores a program and data used for the main CPU 32 to operate, and for example, temporarily holds random numbers to be sampled by a sampling circuit 36 described later after a start of the game, while storing data such as code numbers and symbol numbers of the pseudo reels and the like. The ROM 34 stores a program for the main CPU 32 to execute and permanently held data. In the case of the slot machine 1, the ROM 34 stores a prize determining table, symbol determination table, stop table and payout table each described later.

Further, the slot machine 1 has a random number generator 35, sampling circuit 36, clock pulse generating circuit 37, and divider 38. The random number sampling generator 35 operates according to an instruction of the main CPU 32, and generates random numbers in a predetermined range. The sampling circuit 36 extracts an arbitrary random number from the random numbers generated by the random number generator 35 according to an instruction of the main CPU 32, and inputs the extracted random number to the main CPU 32. The clock pulse generating circuit 37 generates a reference clock to operate the main CPU 32, and the divider 38 inputs a signal obtained by dividing the reference clock at predetermined intervals to the main CPU 32.

The slot machine 1 further has a communication control section 41, communication processing section 42, switch input unit 50, and touch panel 56.

The communication control section 41 operates according to an instruction of the main CPU 32, and controls connection and disconnection of a channel to communicate with the account adjusting server 100. The communication processing section 42 is communication means for operating according to an instruction of the communication control section 41, and executes transmission and reception of data performed via the communication network N. The communication processing section 42 operates as a transmitting section for transmitting taxation information described later to the account adjusting server 100.

The switch input unit 50 has a start switch 51, BET switch 52, line switch 53, stop switch 54 and payout switch 55. The start switch 51 inputs a start signal to the main CPU 32 when detecting an operational input of the spin button 8. The BET switch 52 inputs a BET selection signal to the main CPU 32 when detecting an operational input of the BET selection button 9. The line switch 53 inputs a line selection signal to the main CPU 32 when detecting an operational input of the line selection button 10. The stop switch 54 inputs a stop signal to the main CPU 32 when detecting an operational input of the stop button 11. The payout switch 55 inputs a payout signal to the main CPU 32 when detecting an operational input of the payout button 12.

The touch panel 56 is provided to cover a display screen of the liquid crystal display panel 5, detects a position in a portion with which a finger of a player comes into contact, and inputs a position signal corresponding to the detected position to the main CPU 32. Further, into the touch panel 56 is incorporated an image generating section **56*a*** that generates image data of characters, symbols and the like (for example, an autograph signature input by a player, a fingerprint of the player and the like described later) input using a predetermined pen (not shown).

Further, the slot machine 1 has a lamp driving circuit 59, lamp 60, LED driving circuit 61, LED 62, hopper driving circuit 63, hopper 64, payout completion signal circuit 65, and coin detecting section 66. Furthermore, the slot machine 1 has an image control circuit 71 and sound control circuit 72.

The lamp driving circuit 59 outputs a signal to light the lamp 60 to the lamp 60 so as to cause the lamp 60 to flash during execution of the game (for example, second game). The representation of the game is performed by the flashing. The LED driving circuit 61 controls flashing display of the LED 62. The LED 62 displays the number of sheets of credit, the number of acquired sheets, and the like. The hopper driving circuit 63 drives the hopper 64 according to control of the main CPU 32, and the hopper 64 operates to pay out prize coins, and causes the coins to be paid from the payout opening 13. The coin detecting section 66 counts the number of coins paid out by the hopper 64, and notifies the data of a value of the counted number to the payout completion signal circuit 65. The payout completion signal circuit 65 receives the data of the value of the number of coins from the coin detecting section 66, and when the value of the number reaches data of the set number, inputs a signal notifying the completion of payout of the coins to the main CPU 32.

Figure 4:
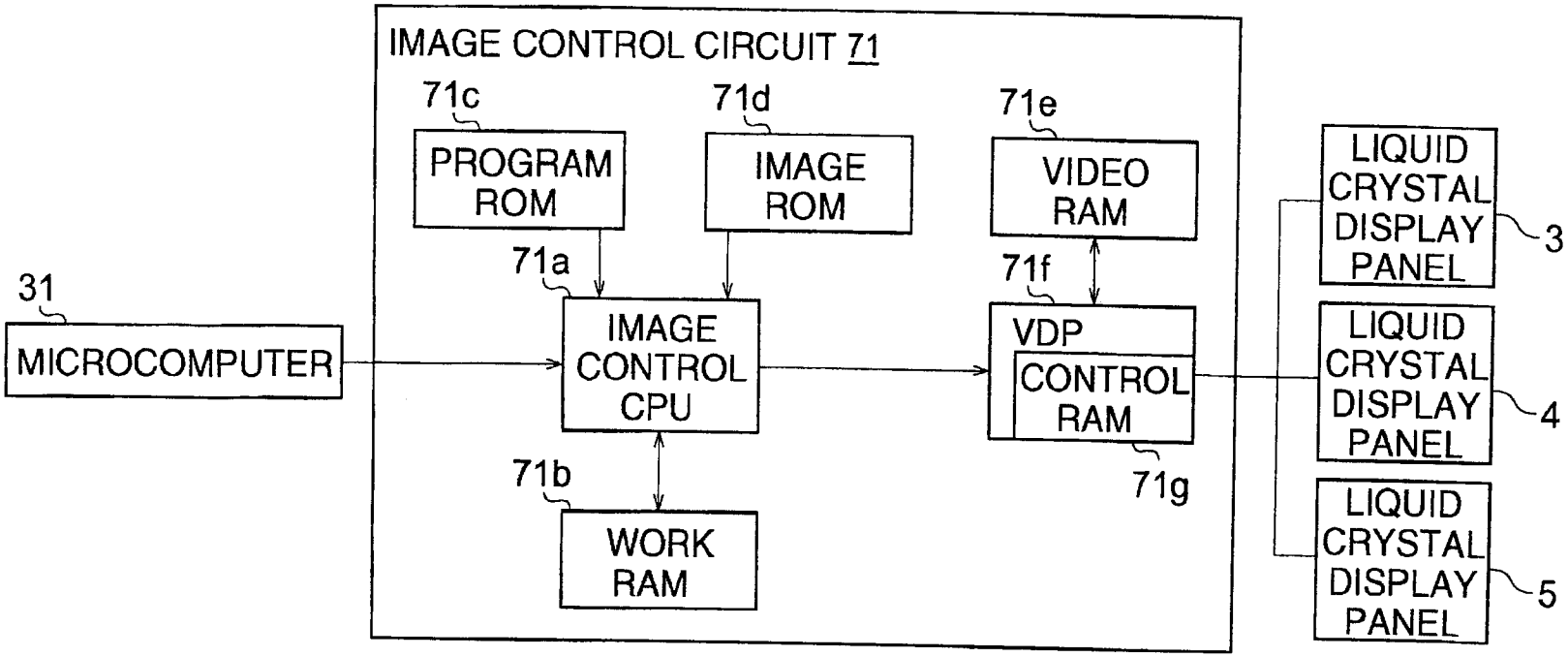
FIG. 4 is a partial block diagram of the slot machine with an image control circuit as a center.

FIG. 4 is a partial block diagram of the slot machine 1 with the image control circuit 71 as a center.

The image control circuit 71 controls image display in each of the liquid crystal display panels 3, 4 and 5, and displays various kinds of images such as variably displayed pseudo reels and the like in the liquid crystal display panels 3 to 5. As shown in FIG. 4, the image control circuit 71 has an image control CPU 71*a*, work RAM 71*b*, program ROM 71*c*, image ROM 71*d*, video RAM 71*e*, and VDP (Video Display Processor) 71*f*. The image control CPU 71*a* determines images (pseudo reels and the like) to be displayed in the liquid crystal display panels 3 to 5, based on parameters set by the microcomputer 31, according to an image control program (related to display in the liquid crystal display panels 3 to 5) beforehand stored in the program ROM 71*c*. The work RAM 71*b* is configured to be a temporary storing means when the image control CPU 71*a* executes the image control program.

The program ROM 71*c* stores the image control program, various selection tables and the like. The image ROM 71*d* stores dot data to form images. The video RAM 71*e* is configured to be a temporary storing means when the VDP 71*f* forms an image. The VDP 71*f* has control RAM 71*g*, forms an image corresponding to the content of display of each of the liquid crystal display panels 3 to 5 determined in the image control CPU 71*a*, and outputs the formed image to each of the liquid crystal display panels 3 to 5.

The sound control circuit 72 inputs a sound signal to output sound from a speaker 73 to the speaker 73. The speaker 73 outputs the sound to boost the game, for example, at appropriate time after a start of the game.

Figure 5:
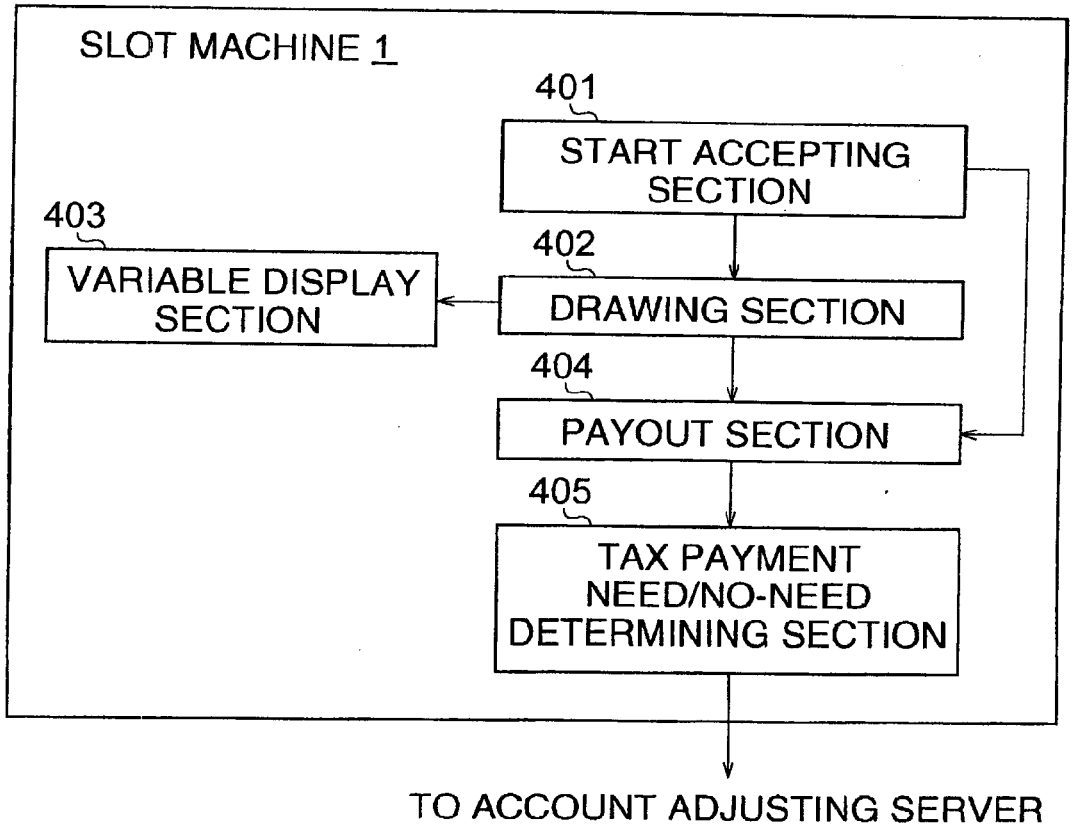
FIG. 5 is a functional block diagram of the slot machine used in the account adjusting system.

FIG. 5 is a functional block diagram of the slot machine 1 used in the account adjusting system 300.

The slot machine 1 has a start accepting section 401, drawing section 402, variable display section 403, payout section 404 and tax payment need/no-need determining section 405. The start accepting section 401, drawing section 402, variable display section 403, payout section 404 and tax payment need/no-need determining section 405 are structural elements mainly implemented by the microcomputer 31 executing a predetermined program.

The start accepting section 401 has functions of starting a game corresponding to operation of a player, while storing the amount bet by the player. The main CPU 32 functioning as the start accepting section receives the operation to start the game from the player. The player performs predetermined operation such as pressing the spin button 8 and the like, and thereby causes the slot machine 1 to start the game. When the start accepting section 401 detects the predetermined operation, the section 401 starts the pseudo reels (so that the pseudo reels are variably displayed). In other words, the player first inserts a number of coins bet on a single game from the coin insertion opening 6, or operates the BET selection button 9 to set the number of coins bet on a single game from coins credited in the slot machine 1, and further operates the line selection button 10 to set an effective line. Next, when the player operates the spin button 8 (hereinafter, the operation is referred to as "start operation"), by the start operation, a start signal is input to the main CPU 32 functioning as the start accepting section 401 from the start switch 51 (in the case of credit, a BET selection signal is input from the BET switch 52.)

The drawing section 402 performs a drawing, and mainly makes a symbol determination to determine a symbol to be stopped on the set effective line for each of the pseudo reels. When receiving a game start instruction from the start accepting section 401, the main CPU 32 functioning as the drawing section 402 instructs the sampling circuit 36 to extract an arbitrary random number from random numbers generated by the random number generator 35. When the main CPU 32 that is the start accepting section 401 extracts the random number, the CPU 32 sets the random number as a search key, refers to the symbol determination table (that is a table storing code numbers of the symbols and random numbers in association with one another) not shown but stored in the ROM 34, and acquires a code number corresponding to the symbol.

Next, the main CPU 32 functioning as the drawing section 402 sets the acquired code number as a search key, refers to the stop table (that is a table storing the code numbers of the symbols and symbols in association with one another) not shown, and searches for the corresponding symbol for each of the pseudo reels.

Then, in the slot machine 1, a drawing of a random number, and searches of the symbol determination table and stop table are thus performed for each of the pseudo reels. Then, when the symbol is determined for each of the pseudo reels, a stop position of each of the reels is determined to stop the symbol on the effective line.

Further, the main CPU 32 functioning as the drawing section 402 refers to the payout table not shown, and determines a rate (payout rate) of payout corresponding to a symbol pattern to store. In addition, with the payout table is registered the payout rate per coin corresponding to each symbol pattern.

The variable display section 403 performs variable display processing corresponding to a result of the drawing by the drawing section 402. In this case, according to an instruction of the main CPU 32 functioning as the variable display section 403, the image control circuit 71 operates, and displays game execution images including variably displayed images of a plurality of pseudo reels in the liquid crystal display panel 5. Then, in the liquid crystal display panel 5, a plurality of pseudo reels is variably displayed in the center with the reels aligned horizontally, and the linear effective line (not shown) extending horizontally is displayed in the center of the panel 5. Each of the pseudo reels has a plurality of symbols, and is variably displayed so that each symbol appears successively in irregular order. After starting the variable display, the variable display section 403 performs stop control processing. Herein, each of the scrolled pseudo reels is stopped to stop each symbol according to the result of the drawing by the drawing section 402.

The payout section 404 determines an award to pay out to the player based on the result of the drawing determined by the drawing section 402 and the bet amount received in the start accepting section 401. More specifically, the award is a value obtained by multiplying the rate of payout (payout rate) corresponding to the symbol pattern that is a stopped pattern and that is determined in the drawing section 402 by referring to the payout table by the bed amount.

The tax payment need/no-need determining section 405 determines the need or no-need of tax payment based on the award determined by the payout section 404. In other words, the main CPU 32 functioning as the tax payment need/no-need determining section 405 determines whether the award determined in the payout section 404 is an award (hereinafter, referred to a "tax target award") targeted for tax requiring tax payment. Herein, when the award corresponds to the tax target award, the tax payment need/no-need determining section 405 transmits a tax payment processing request message to the account adjusting server 100. Meanwhile, when the award does not correspond to the tax target award, the section 405 requests the payout section 404 to execute the payout. Whether or not the award corresponds to the tax target award is determined on whether or not the award (the amount to be paid out) determined by the payout rate acquired from the payout table and the bet coins is a predetermined value or more (for example, when the place where the slot machines 1 are installed is Las Vegas, Nev., USA, whether the award is 1,200 dollars or more), but is not limited to this condition.

In addition, the tax payment processing request message includes information required for tax payment processing and preparation of a tax payment certificate such as the award amount, player identification information (for example, player ID, house card ID or the like) that uniquely specifies the player that is a recipient of the award, and the like.

[Account Adjusting Server]

Referring to FIG. 1 again, described next is the account adjusting server 100 that is a structural element of the account adjusting system 300 according to this embodiment.

The account adjusting server 100 is an apparatus which compiles amounts (hereinafter, purchase amounts) of purchased articles and services of a user such as a guest, player and the like, calculates the total cost including the cost of accommodation, and adjusts an account of the total cost in check-out, while performing tax payment procedures (including preparation of a tax payment certificate) corresponding to an award when the guest gains the amount of award requiring tax payment in the casino 201.

Figure 6:
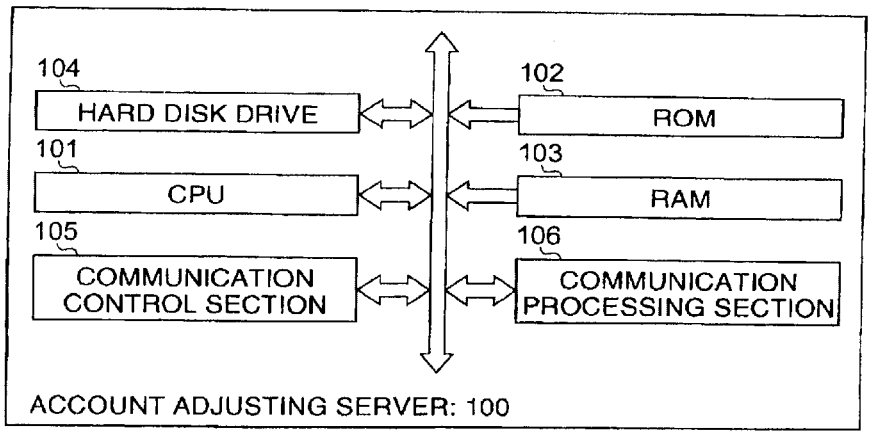
FIG. 6 is a block diagram showing a hardware configuration example of an account adjusting server.

As shown in FIG. 6, the account adjusting server 100 has a CPU 101, ROM 102, RAM 103, hard disk drive 104, communication control section 105 and communication processing section 106, and is configured to be able to communicate with the slot machines 1 via the communication network N. In addition, FIG. 6 is a block diagram showing a hardware configuration example of the account adjusting server 100.

The CPU 101 operates according to a program stored in the ROM 102 to control the entire operation of the account adjusting server 100, and operates as the receiving section, compiling section, statement of account issuing section, and tax payment certificate providing section of the invention. The ROM 102 stores the control program that the CPU 101 executes and permanently stored data. The RAM 103 stores the data used for the CPU 101 to operate.

The hard disk drive 104 stores data transmitted from the slot machines 1 e.g. various kinds of data including award information in this embodiment, and a program. The communication control section 105 operates according to an instruction from the CPU 101, and controls connection and disconnection of a channel to communicate with the slot machines 1. The communication processing section 106 operates according to an instruction of the communication control section 105, and executes transmission and reception of the data performed via the communication network N. The communication processing section 106 operates as the receiving section for receiving a tax payment processing request message from the slot machine 1.

Figure 7:
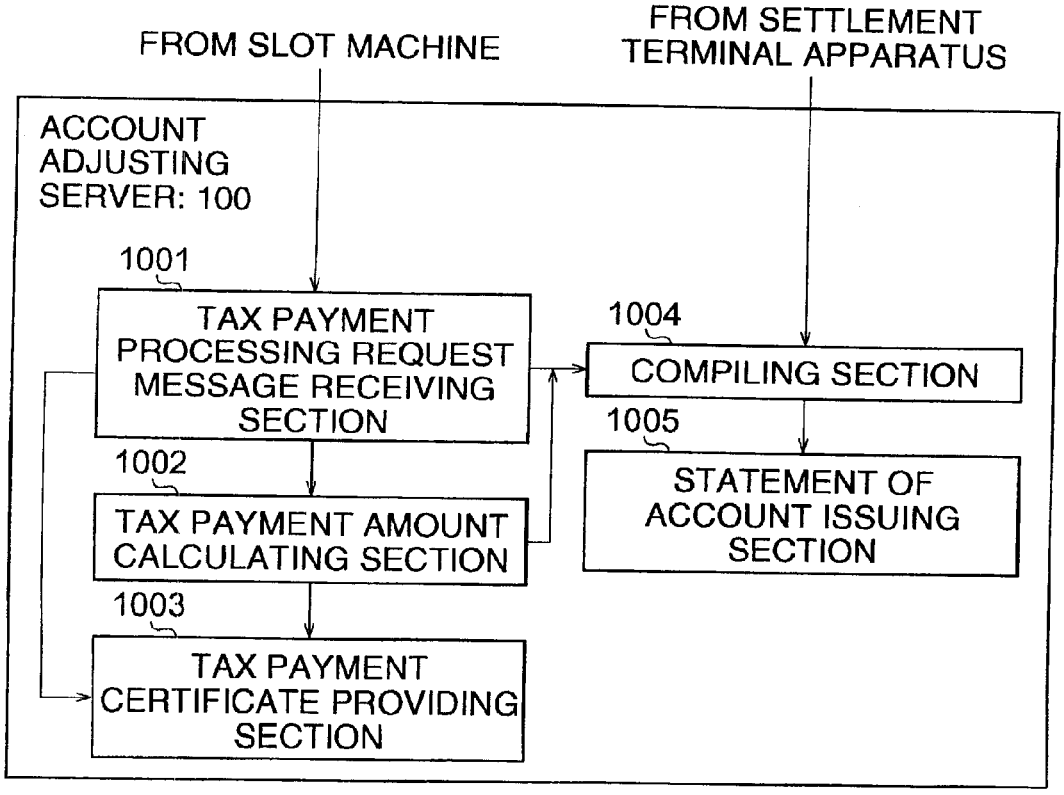
FIG. 7 is a functional block diagram showing a configuration example of the account adjusting server.

FIG. 7 is a functional block diagram showing a configuration example of the account adjusting server 100. In the configuration example as shown in the figure, the account adjusting server 100 has a tax payment processing request message receiving section 1001, tax payment amount calculating section 1002, tax payment certificate providing section 1003, compiling section 1004 and statement of account issuing section 1005.

The tax payment processing request message receiving section 1001 has functions of receiving a tax payment processing request message transmitted from the slot machine 1 via the communication network N to store.

Further, the tax payment processing request message receiving section 1001 notifies an award included in the tax payment processing request message to the compiling section 1004 described later.

The tax payment amount calculating section 1002 has functions of calculating a tax payment amount on the award corresponding to the tax payment processing request message, based on the tax payment processing request message stored in the tax payment processing request message receiving section 1001. For example, when the award amount included in some tax payment processing request message is $1200 and the tax rate is 30%, the tax payment amount calculating section 1002 calculates the tax payment amount as $1200×30%=$360.

Further, the tax payment amount calculating section 1002 notifies the calculated tax payment amount to the tax payment certificate providing section 1003 described later and the compiling section 1004.

The tax payment certificate providing section 1003 acquires information (for example, the award amount, tax payment amount, and information (for example, player ID, guest ID, house card ID or the like) that specifies the player that is a tax payer) required for issue of the tax payment certificate from the tax payment processing request message receiving section 1001 and tax payment amount calculating section 1002, and transmits these pieces of information to an output apparatus 120 to issue the tax payment certificate. By the output apparatus 120 outputting the information, the player is capable of receiving issue of the tax payment certificate in checking out.

The compiling section 1004 has functions of receiving the purchase information transmitted from each settlement terminal apparatus 110 via the communication network N, and compiling these pieces of purchase information for each payer to store. The purchase information is such information that shows when and where each user purchases and what amount. By compiling these pieces of purchase information, the total amount of each user's purchasing in the hotel is calculated in checking out the hotel, and the amount billed to the user is determined.

FIG. 8 is a diagram showing a data configuration example of account adjusting information generated by the compiling section 1004 compiling the purchase information. The account adjusting information is generated in principle for each user (only for a representative person when two or more people stay together). The account adjusting information 800 as shown in FIG. 8 has the purchase information 801, 802 and 803 received from the settlement terminal apparatuses 110, the award amount information 804 received from the tax payment processing request message receiving section 1001, and the tax payment amount information 805 received from the tax payment amount calculating section 1002. The compiling section 1004 has bill amount information 806 of a sum of values of the purchase information 801, 802 and 803, the award amount information 804, and the tax payment amount information 805. The amount indicated in the bill amount information 806 is the amount that the hotel charges the user.

Based on the account adjusting information 800 stored in the compiling section 1004, the statement of account issuing section 1005 issues a statement of account (including the bill) for the user to adjust the cost of accommodation and the like of the user in checking out using the output apparatus 120 or another printing apparatus (not shown). Based on the output statement of account, a person in charge (at the front desk) of the hotel 200 receives cash from the user, performs billing processing using a credit card of the user, or adjusts an account from the amount deposited by the user in check-in.

[Settlement Terminal Apparatus]

Referring to FIG. 1 again, the explanation of the account adjusting system 300 will be continued.

The account adjusting server 100 is connected to the settlement terminal apparatuses 110 via the network such as intra-hotel LAN and the like. Each of the settlement terminal apparatuses 110 is an apparatus that transmits a payment amount by a user to the account adjusting server 100, and is a credit card terminal, debit card terminal, house card (which is a card issued by the hotel and has the settlement function) terminal and the like.

[Output Apparatus]

Further, the account adjusting server 100 is connected to the output apparatus 120 to issue a tax payment certificate. The output apparatus 120 is a printing apparatus that issues a tax payment certificate, or a display device that displays information such as the award amount, award payout date, slot machine number and the like required to fill required items in a form of the tax payment certificate.

[Communication Network]

The communication network N acts to enable an apparatus connected to the network N to transmit and receive data to/from a target apparatus when a session is established between the apparatuses, irrespective of wired/wireless channel, or dedicated channel/switched channel. The communication network N may be implemented by combining a plurality of communication networks via gateways, such as the Internet. For example, the communication network N may be formed of a cellular telephone network and a data communication network connected to the cellular telephone network via a gateway. Furthermore, for connection, the communication network N may connect temporarily by PPP (Point to Point Protocol) connection without directly connecting to the so-called backbone, as long as data can be transmitted and received between apparatuses when a session is established. In addition, the above-mentioned communication network N includes a network (communication network) without using a switching apparatus such that the dedicated channels are provided to be fixed. Further, when the data is transmitted and received, it is preferable that the data or communication network is provided with any encryption to transmit and receive the data. This is because of enhancing security.

[Operation Example of the Account Adjusting System]

Figure 9:
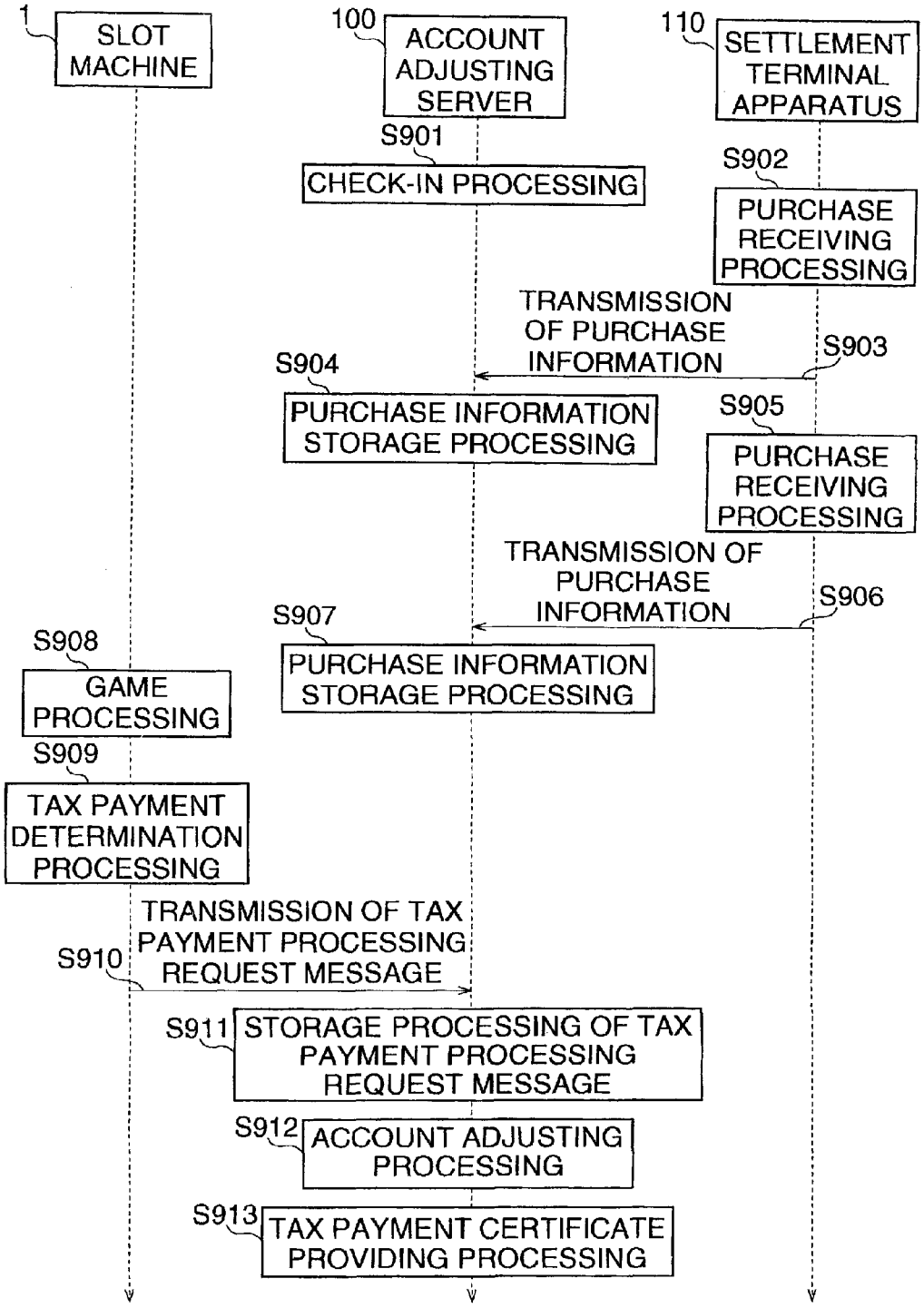
FIG. 9 is a sequence diagram illustrating an operation example of the account adjusting system.

Described next is an operation example of the account adjusting system 300 with the above-mentioned configuration with reference to FIG. 9. FIG. 9 is a sequence diagram illustrating the operation example of the account adjusting system 300.

When a user uses facilities (including the casino 201) in the hotel 200, the user first performs check-in processing at the front desk 205 or the like (S901). The check-in processing in this embodiment is to register pieces of information (name, address, bank account for withdrawal, credit number and the like) to allow the user to use the facilities in the hotel with the account adjusting server 100, and to determine a user ID that is information to uniquely specify the user in association with the pieces of information to issue. For example, a debit card, deposit card and ID card usable in the hotel 200 are issued to a user, and using the ID number registered with such a card as a key, the purchase receiving processing and account adjusting processing described later is performed.

When the check-in processing is finished, the user is allowed to use the facilities, get services, purchase articles, and the like in the hotel 200. More specifically, the user inputs the user ID and use amount to the settlement terminal apparatus 110 to adjust an account in check-out, and is thereby capable of using various facilities, getting services, purchasing articles and the like in a cashless manner, without performing payout procedures by cash or credit card on the spot.

When a user desires to use a facility, get a service, purchase an article or the like in the hotel 200 using the user ID, the settlement terminal apparatus 110 performs the purchase receiving processing (S902). The purchase receiving processing (S902) is processing of receiving inputs of the user ID and use amount (that may be a price or charge) corresponding to the use of the facility, getting of the service or purchase of the article in the hotel using the user ID. The input method allows any methods, for example, a method for an operator (hotel staff member, shopkeeper or the like) to manually input using a keyboard, a method of reading the house card magnetically or electrically, or a method of reading an ID tag storing the user ID and the amount using a reader/writer.

When the purchase receiving processing (S902) is finished, the settlement terminal apparatus 110 transmits the purchase information to the account adjusting server 100 (S903). The purchase information is information including the user ID and use amount input in the previous purchase receiving processing (S902). The amount that the user uses is stored in the account adjusting server 100 from the purchase information, and the adjusted amount is calculated in adjusting an account.

The account adjusting server 100 receiving the purchase information accumulates and stores the received purchase information in the compiling section 1004 (S904) and prepares for subsequent account adjusting processing (S912).

The purchase receiving processing, transmission of the purchase information and purchase information storage processing is performed whenever the user uses a facility, gets a service or purchases an article using the user ID (S905, S906, S907). In addition, FIG. 9 shows the example where the purchase processing is performed twice in the same settlement terminal apparatus 110. However, in the account adjusting system 300 according to this embodiment, it is naturally possible for a user to make purchases without being limited in the number of uses in any one of the settlement terminal apparatuses 110.

The user is capable of playing a game using the slot machine 1 that is a game machine in the casino 201. The slot machine 1 starting the game performs game processing (S908). The game processing is processing of determining success or failure of acquisition of a prize by a drawing, and when a prize is acquired, paying an award corresponding to an aspect of the prize (prize combination).

The slot machine 1, more specifically, the tax payment need/no-need determining section 405 performs tax payment determination processing of determining whether or not an amount of the award is an amount requiring tax payment, when acquisition of the prize occurs to pay the award (S909).

Next, when it is determined that the amount of the award is the amount requiring tax payment, the slot machine 1 generates a tax payment processing request message to transmit to the account adjusting server 100 (S910). The tax payment processing request message includes a user ID that specifies the user who acquires the prize that is a cause of the award, and information indicative of the amount of the award.

The account adjusting server 100 receiving the tax payment processing request message, more specifically, the tax payment processing request message receiving section 1001 stores the received tax payment processing request message (S911), and prepares for subsequent account adjusting processing (S912).

The account adjusting server 100 executes the account adjusting processing at the time the user checks out (S912). The account adjusting processing (S912) is processing required for account adjusting operations e.g. processing of issuing a statement of account based on the account adjusting information 800 (see FIG. 8) described previously.

Further, when a user targeted for the account adjusting processing acquires the award targeted for tax payment, with the account adjusting processing (S912), the account adjusting server 100 executes tax payment certificate providing processing (S913). The tax payment certificate providing processing is processing of transmitting pieces of information to the output apparatus 120 so as to issue the tax payment certificate. The output apparatus 120 outputs the pieces of information received from the account adjusting server 100, and the player is thereby capable of receiving issue of the tax payment certificate in checking out.

According to the account adjusting system 300 as described above, a user that is the player is capable of completing tax payment procedures in checking out the hotel 200. As the result, the player eliminates the need of halting the game and waiting a long time due to the tax payment procedures during the game, and is capable of increasing the time the user uses optionally, as compared with the conventional case.

In other words, according to this account adjusting system 300, a hotel slip (including a statement of account and bill) and a tax payment certificate can be issued at the same time in check-out of the hotel, it is thereby possible to eliminate effort of tax payment of a user and the time consumed for tax payment, and the time can be increased that a player who is the user can use optionally.

[Modifications]

The account adjusting system 300 is capable of being modified in various manners. Modifications of the account adjusting system according to this embodiment will be described below.

(1) The account adjusting system may have a game server that is a section for collectively calculating tax payment amounts when awards requiring tax payment arise in a plurality of different slot machines 1.

Figure 10:
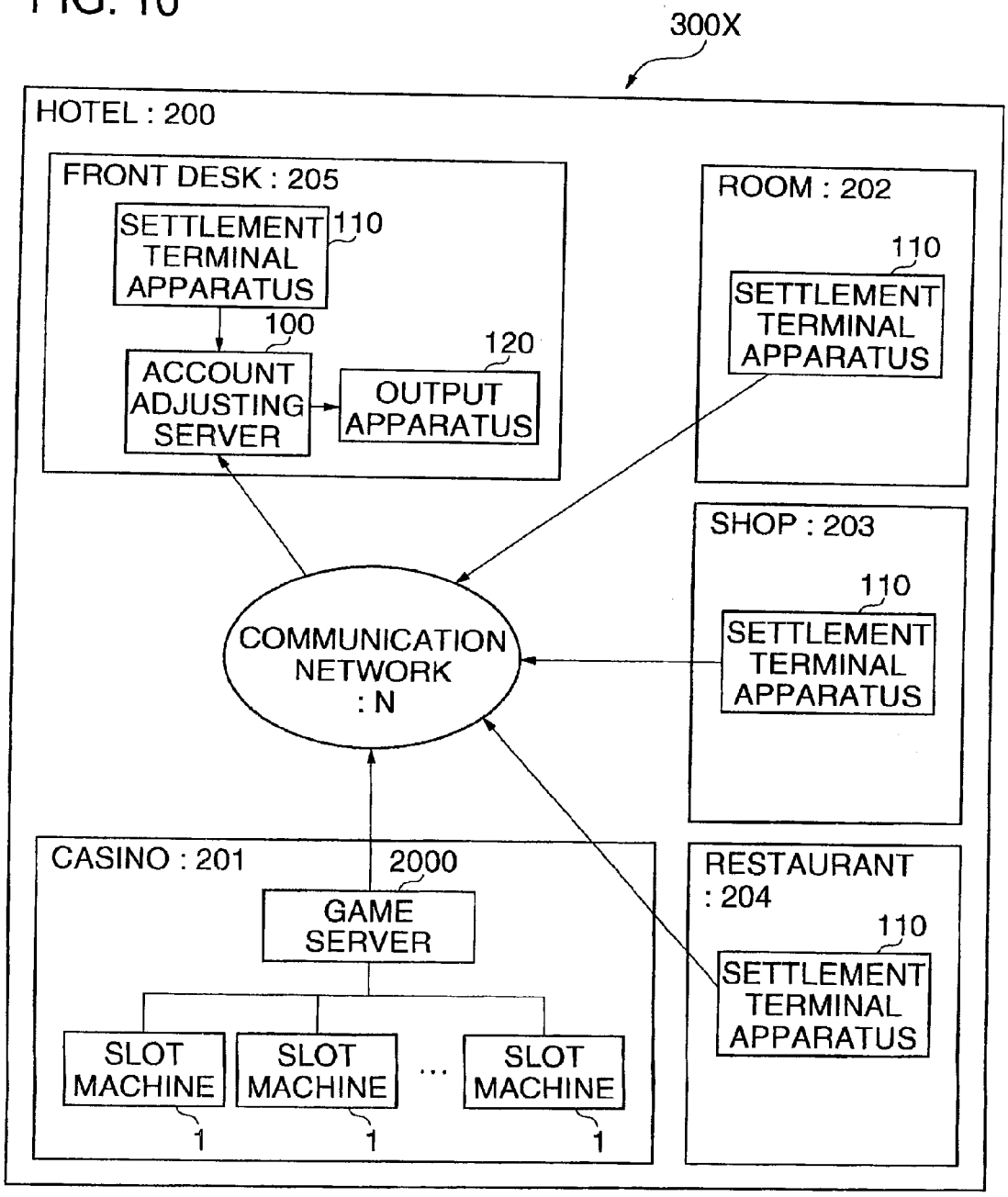
FIG. 10 is a block diagram illustrating a modification of the account adjusting system.

FIG. 10 is a block diagram illustrating a modification of the account adjusting system 300.

The account adjusting system 300X according to the modification differs from the account adjusting system 300 in a respect that the system 300X further has a game server 2000 installed in the casino, and has the same configuration as that of the account adjusting system 300 except the aforementioned respect, and the same structural elements are assigned the same reference numerals to omit specific descriptions thereof.

The game server 2000 is connected to a plurality of slot machines 1, while being able to connect to the communication network N, and to the account adjusting server 100 via the communication network N.

The game server 2000 is an apparatus having the same configuration as that of the hardware of the account adjusting server 100 as shown in FIG. 5. In other words, the server 2000 has a CPU 101, ROM 102, RAM 103, hard disk drive 104, communication control section 105 and communication processing section 106, and is configured to be able to communicate with the slot machines 1 and to communicate with the account adjusting server 100 via the communication network N.

The game server 2000 has functions of receiving a tax payment processing request message from each slot machine 1 when the tax payment target award arises, storing the tax payment processing request message, calculating the tax payment amount for each user at predetermined timing, and notifying the calculated tax payment amount to the account adjusting server 100. The game server 2000 compiles awards exceeding the amount requiring tax payment and tax payment amounts of each user based on the tax payment processing request messages at predetermined timing (after a lapse of predetermined time, the time of receiving inquiry from the account adjusting server 100, and the like), and notifies the account adjusting server 100 of the awards and tax payment amounts obtained by compiling. In addition, the notification may be performed by transmitting a new tax payment processing request message based on the compiled result. Alternately, another type of message may be used for the notification.

For example, it is assumed that some user acquires an award exceeding the amount requiring tax payment in a slot machine X. The slot machine X transmits a tax payment processing request message to the game server 2000 to notify that the user acquires the award requiring tax payment to the game server 2000. The game server 2000 stores the tax payment processing request message.

It is further assumed that the user starts a game in another slot machine Y subsequently, and acquires an award exceeding the amount requiring tax payment in the slot machine Y. In the same way as in the slot machine X, the slot machine Y transmits a tax payment processing request message to the game server 2000 to notify that the user acquires the award requiring tax payment to the game server 2000. The game server 2000 stores the tax payment processing request message.

When the predetermined timing comes, the game server 2000 compiles the awards acquired in both the slot machines X and Y and tax payment amounts, and notifies the account adjusting server 100 of the compiled result. In addition, for the compiled result, only the result of summation may be notified. Alternately, the awards and tax payment amounts may be notified individually.

Figure 11:
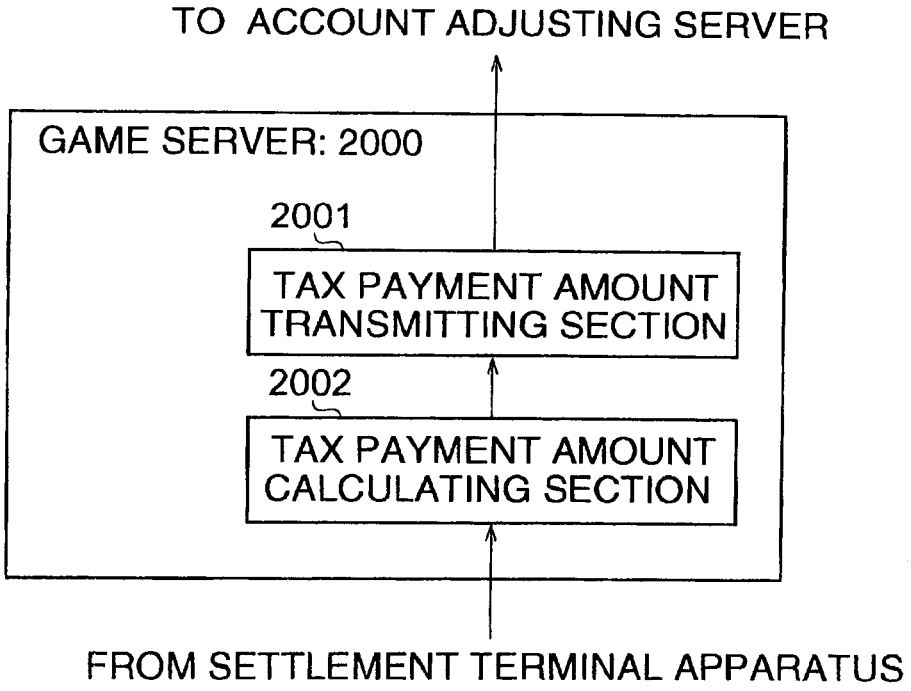
FIG. 11 is a functional block diagram showing a configuration example of a game server.

FIG. 11 is a functional block diagram showing a configuration example of the game server 2000. The game server 2000 has a tax payment amount calculating section 2002 which receives a tax payment processing request message from each of the slot machines 1, and calculates a tax payment amount based on the received tax payment processing request message, and a tax payment amount transmitting section 2001 that transmits the award amount information indicative of an award included in the tax payment processing request message, and the tax payment amount information indicative of the tax payment amount calculated in the tax payment amount calculating section.

According to the account adjusting system 300X modified as described above, even when awards requiring tax payment are acquired in a plurality of game machines, the game server is capable of collectively calculating tax payment amounts to transmit to the account adjusting server. Therefore, it is possible to eliminate effort of tax payment and the time consumed for tax payment that conventionally arises in the game machines, and the time can further be increased that a player is capable of using optionally.

(2) In the above-mentioned embodiment, it is configured that the tax payment amount is calculated in the account adjusting server 100 or game server 2000, but the invention is also established in a configuration that the slot machine 1 calculates the tax payment amount.

In this manner, according to the invention, it is possible to issue a tax payment certificate on the acquired award concurrently with an issue of documents for account adjustment such as a statement of account, bill and the like at the time of adjusting an account such as the time of checking out a hotel and the like, and it is thereby possible to eliminate effort for tax payment of a user and the time consumed for tax payment.

In addition, the system according to the invention may be configured to further have an authentication server for personal authentication used in the case of performing processing related to inputs and identification of a user. Such a configuration authenticates personal identification in each processing for a player that is a user of the system, and is thereby capable of suppressing unauthorized use of a third party when the card is stolen and the like, and of improving security of the system.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

The invention claimed is:

1. A gaming system, comprising, in combination:

one or more gaming machines; and an account-adjusting device in data communication with each of the gaming machines;

wherein each of the gaming machines includes a housing;

a value-addition mechanism by which a player adds gaming media to be bet to the gaming machine;

a validator which validates the authenticity of bills or other physical, value-bearing media used to add gaming media to be bet to the gaming machine;

a plurality of input buttons including a bet button by which the player wagers an amount of gaming media that has been added to the gaming machine via the value-addition mechanism and that has monetary value associated therewith; a spin button by which the player causes a game to be executed; and a payout button by which the player can obtain from the gaming machine a payout of an amount of gaming media; and an associated game-play microcomputer including a microprocessor, wherein the game-play microcomputer is programmed to perform the steps, as a result of the player having wagered gaming media and having caused a game to be executed, of (i) executing the game;

(ii) determining an award, if any, to be paid to the player based on a result of the game and the amount of gaming media the player has wagered; and (iii) determining whether the award to be paid to the player, if any, is subject to a tax payment and, if so, sending a tax-payment-processing-request to the account-adjusting device without reducing the amount of the award to be paid by the amount of the tax payment to which it is subject and without suspending the ability to execute games on the gaming machine; and wherein the account-adjusting device includes an account-adjusting microcomputer including a microprocessor, the account-adjusting microcomputer being programmed to perform the steps of a) receiving a tax-payment-processing-request message sent by the game-play microcomputer associated with one of said gaming machines in response to a given player winning a taxable award at said one of said gaming machines;

b) receiving data pertaining to non-gaming charges accumulated by the given player throughout an establishment in which the gaming system is installed;

c) using the data pertaining to non-gaming charges accumulated by the given player; uncollected award amounts, if any; and any tax payments to which awards are subject, determining a total amount due from the given player in settlement of an account associated with the given player; and d) providing tax-payment-certification data to an output device upon settlement of the account associated with the given player.

2. The gaming system of claim 1, further comprising a printer configured to issue tax payment certificates, and wherein the account-adjusting microcomputer is programmed to provide the tax-payment-certification data to the printer.

3. The gaming system of claim 1, further comprising a display device for display of information required to complete tax payment certificates, and wherein the account-adjusting microcomputer is programmed to provide the tax-payment-certification data to the display device.

4. The gaming system of claim 1, wherein the account-adjusting microcomputer is programmed to calculate an amount of tax due in connection with the taxable award won by the given player.

5. The gaming system of claim 1, wherein each gaming machine is able to calculate an amount of tax due in connection with the taxable award won by the given player and to communicate the amount of tax due to the account-adjusting device.

6. The gaming system of claim 1, wherein each of the gaming machines includes its own internal microcomputer.

7. The gaming system of claim 1, wherein the game-play microcomputer associated with each of the gaming machines comprises a single external game server in data communication with all of the gaming machines.

8. A gaming facility, comprising:

one or more physical building structures, which can be occupied by human occupants as edifices;

one or more gaming machines and an account-adjusting device located within said one or more physical building structures, with the account-adjusting device in data communication with each of the gaming machines;

wherein each of the gaming machines includes a housing;

a value-addition mechanism by which a player adds gaming media to be bet to the gaming machine;

a validator which validates the authenticity of bills or other physical, value-bearing media used to add gaming media to be bet to the gaming machine;

a plurality of input buttons including a bet button by which the player wagers an amount of gaming media that has been added to the gaming machine via the value-addition mechanism and that has monetary value associated therewith; a spin button by which the player causes a game to be executed; and a payout button by which the player can obtain from the gaming machine a payout of an amount of gaming media; and an associated game-play microcomputer including a microprocessor, wherein the game-play microcomputer is programmed to perform the steps, as a result of the player having wagered gaming media and having caused a game to be executed, of (i) executing the game;

(ii) determining an award, if any, to be paid to the player based on a result of the game and the amount of gaming media the player has wagered; and (iii) determining whether the award to be paid to the player, if any, is subject to a tax payment and, if so, sending a tax-payment-processing-request to the account-adjusting device without reducing the amount of the award to be paid by the amount of the tax payment to which it is subject and without suspending the ability to execute games on the gaming machine; and wherein the account-adjusting device includes an account-adjusting microcomputer including a microprocessor, the account-adjusting microcomputer being programmed to perform the steps of a) receiving a tax-payment-processing-request message sent by the game-play microcomputer associated with one of said gaming machines in response to a given player winning a taxable award at said one of said gaming machines;

b) receiving data pertaining to non-gaming charges accumulated by the given player throughout the gaming facility;

c) using the data pertaining to non-gaming charges accumulated by the given player; uncollected award amounts, if any; and any tax payments to which awards are subject, determining a total amount due from the given player in settlement of an account associated with the given player; and d) providing tax-payment-certification data to an output device upon settlement of the account associated with by the given player; and one or more terminals located throughout the physical building structures and at which players can incur non-gaming charges.

9. The gaming facility of claim 8, wherein the one or more physical building structures comprise a hotel with guest rooms and the gaming machines are located in a casino associated with the hotel.

10. The gaming facility of claim 9, wherein some of said one or more terminals at which players can incur non-gaming charges are located within the guest rooms.

* * * * *